US008360483B2

(12) United States Patent
Koppel et al.

(10) Patent No.: US 8,360,483 B2
(45) Date of Patent: Jan. 29, 2013

(54) DOOR LOCK FOR DOORS OF AIRCRAFT, ESPECIALLY OF HELICOPTERS

(75) Inventors: Klaus Koppel, Asbach-Baumenheim (DE); Alexander Rowbut, Aix-en Provence (FR)

(73) Assignee: Eurocopter Deutschland GmbH, Donauwoerth (DE)

( * ) Notice: Subject to any disclaimer, the term of this patent is extended or adjusted under 35 U.S.C. 154(b) by 630 days.

(21) Appl. No.: 12/516,453

(22) PCT Filed: Nov. 26, 2007

(86) PCT No.: PCT/DE2007/002125

§ 371 (c)(1),
(2), (4) Date: Aug. 6, 2009

(87) PCT Pub. No.: WO2008/064650

PCT Pub. Date: Jun. 5, 2008

(65) Prior Publication Data

US 2010/0064740 A1 Mar. 18, 2010

(30) Foreign Application Priority Data

Nov. 28, 2006 (DE) ..... 10 2006 056 442

(51) Int. Cl.
*E05C 3/04* (2006.01)

(52) U.S. Cl. ..... 292/216

(58) Field of Classification Search ..... 292/1, 216, 292/194, 219, 220, 222, 223, 226, 200, DIG. 42, 292/DIG. 23
See application file for complete search history.

(56) References Cited

U.S. PATENT DOCUMENTS

| | | | | | |
|---|---|---|---|---|---|
| 2,797,116 | A | * | 6/1957 | Jaster | 292/29 |
| 2,924,473 | A | * | 2/1960 | Krause | 292/11 |
| 3,188,126 | A | * | 6/1965 | Krause | 292/11 |
| 3,236,551 | A | * | 2/1966 | Nash | 292/11 |
| 3,239,260 | A | * | 3/1966 | Beckman et al. | 292/11 |
| 3,397,906 | A | * | 8/1968 | Beckman et al. | 292/29 |
| 3,430,382 | A | * | 3/1969 | Metz | 49/37 |
| 3,905,624 | A | * | 9/1975 | Fujita | 292/11 |
| 4,369,937 | A | * | 1/1983 | LeBell et al. | 244/53 R |
| 4,875,724 | A | * | 10/1989 | Gruber | 292/216 |
| 4,936,611 | A | * | 6/1990 | Palvolgyi | 292/28 |
| 4,961,601 | A | * | 10/1990 | Lindholm et al. | 292/216 |

(Continued)

FOREIGN PATENT DOCUMENTS

| | | |
|---|---|---|
| DE | 37 07 323 | 9/1988 |
| DE | 195 30 723 | 2/1997 |

(Continued)

OTHER PUBLICATIONS

International Search Report dated Jun. 25, 2008, from corresponding PCT application.

*Primary Examiner* — Carlos Lugo
*Assistant Examiner* — Mark Williams
(74) *Attorney, Agent, or Firm* — Brooks Kushman P.C.

(57) ABSTRACT

The invention relates to a door lock comprising a door catch system for double door-type helicopter doors that can, when being closed, additionally be displaced perpendicularly to the plane of the door opening into the closed position (flush fitting). Said door lock comprises a catch element (30) associated with the latch element (31) and actively linked therewith, said catch element maintaining the door 'caught' directly in front of its locked position when the door is manually closed until the door is translated to its final closed position via the latch element (31).

14 Claims, 2 Drawing Sheets

U.S. PATENT DOCUMENTS

| | | | | |
|---|---|---|---|---|
| 4,961,602 | A * | 10/1990 | Pettersson | 292/97 |
| 4,991,884 | A * | 2/1991 | Cairns | 292/28 |
| 5,048,877 | A * | 9/1991 | Rogers et al. | 292/110 |
| 5,618,069 | A * | 4/1997 | Konchan et al. | 292/216 |
| 6,012,747 | A * | 1/2000 | Takamura et al. | 292/216 |
| 6,109,670 | A * | 8/2000 | Tomaszewski et al. | 292/216 |
| 6,120,070 | A * | 9/2000 | Myers | 292/163 |
| 6,158,787 | A * | 12/2000 | Kutschat | 292/214 |
| 6,471,261 | B1 * | 10/2002 | Messler | 292/238 |
| 6,547,291 | B1 * | 4/2003 | Schwaiger | 292/216 |
| 6,550,824 | B1 * | 4/2003 | Ramsauer | 292/126 |
| 6,679,531 | B2 * | 1/2004 | Rogers et al. | 292/216 |
| 6,688,658 | B2 * | 2/2004 | Mori et al. | 292/56 |
| 6,908,137 | B2 * | 6/2005 | Doxey et al. | 296/65.16 |
| 7,204,526 | B2 * | 4/2007 | Seo | 292/24 |
| 7,261,337 | B2 * | 8/2007 | Nakagome et al. | 292/216 |
| 7,267,377 | B2 * | 9/2007 | Marzolf et al. | 292/25 |
| 7,329,164 | B2 * | 2/2008 | Bermal | 441/42 |
| 7,338,097 | B2 * | 3/2008 | Marzolf et al. | 292/216 |
| 7,506,903 | B2 * | 3/2009 | Sattler et al. | 292/216 |
| 7,959,195 | B2 * | 6/2011 | Harvey et al. | 292/201 |
| 8,029,030 | B2 * | 10/2011 | Shimura et al. | 292/216 |
| 2005/0280265 | A1 * | 12/2005 | Iliescu et al. | 292/216 |
| 2008/0129056 | A1 * | 6/2008 | Hernandez et al. | 292/98 |
| 2011/0025077 | A1 * | 2/2011 | Meyer et al. | 292/216 |

FOREIGN PATENT DOCUMENTS

| | | |
|---|---|---|
| DE | 202 10 249 | 2/2003 |
| DE | 103 59 737 | 7/2005 |

* cited by examiner

DOOR LOCK FOR DOORS OF AIRCRAFT, ESPECIALLY OF HELICOPTERS

TECHNICAL FIELD

The invention relates to a door lock for doors of aircraft, especially of helicopters.

BACKGROUND

These doors are conventionally made as folding doors for boarding of pilots. Differently than in ground vehicles, in aircraft the doors present there within the openings provided in the fuselage structure must be absolutely securely closed—filled in—whereby for the necessary sealing, there are so-called gas compression springs generally between the door and door opening.

Closing of these doors therefore requires three successive manual manipulations, specifically pulling the door shut, holding the door in this state, and then locking it. To do this, the door structure is connected to several door locks whose tumblers that interact with catches attached to the fuselage structure can be jointly actuated by way of a suitable linkage that has a handle. Therefore, when these doors are closed, a considerable expenditure of force is necessary for the last two manipulations since the respective door when locking must be held relatively tightly shut. If the door is not shut strongly enough, it can happen that as a result of the force of the gas springs, one tumbler or another engages "space," and therefore the pertinent door is not properly locked. Moreover, generally both hands of the pertinent person are needed to close the door.

Previously known door locks of locking devices for these doors are obviously user-unfriendly. For opening the door, as long as the pertinent individual is standing in front of the helicopter, there is enough room and freedom of motion for opening and closing the door, and pulling, pressing and turning the handle can be done without major difficulties. This changes immediately, however, after boarding and sitting down in the helicopter; due to the limited ergonomy and the fact that the pilots' seats are made adjustable forward and up depending on body size, operation of these doors becomes many times more difficult.

The doors of a helicopter constitute the first contact with the aircraft and thus determine the first impression on the respective user: there is therefore the requirement that the doors be made self-explanatory in terms of their operability and function and that they not already form the first manual and/or technical obstacle when boarding the helicopter. The functions of door locking should likewise be understandable and logical to anyone, without additional signs and instructions.

A generic door locking device for helicopter doors is available and in use for the helicopter Eurocopter EC 135 as special equipment.

DE 37 07 323 A1 discloses a door locking system, especially for a helicopter door, with two cradle locks that operate in opposite directions, by which the door folds in the closed position are automatically centered with respect to the door frame and braced by compression or tension with the door frame in the direction of the two-dimensional extension of the door fold. The disadvantage here is that the door folds must be held in the closed position when being locked so that two hands are necessary for a closing process.

DE 103 59 737 A1 discloses a device for locking the hood of a motor vehicle. The device has at least one main closure and at least one auxiliary closure that each comprise a latch with a ratchet and a latching member that can be locked by the latch in the closed position of the hood. To initially limit the opening travel of the hood, the latching member of the auxiliary closure is made such that with the main closure unlocked, only after intentional opening travel of the hood does the locking action between the latching member and the latch of the auxiliary closure begin. In this connection, it is disadvantageous that in the half-engaged position, i.e., after activating the latch, a gap remains between the hood and body.

SUMMARY

The object of the invention is therefore to devise a new door locking device that can be better operated than in the past while preserving closing safety.

Proceeding from a door locking system of the initially named type, this object is achieved according to the invention.

Other features of the invention will become apparent from the dependent claims.

The new door locking system is surprisingly advantageous.

Using the catch hook according to the invention that is dynamically connected by gearing to the locking hook, specifically before the locking hook takes effect, the pertinent door made as a folding door is "caught" in the closed position in which the locking hook is only in the region of the catch so that simply by continuing to move the locking hook into its closed position by way of the indicated handle, the door can be transferred into its final closed position without the necessity of manually holding/tightening/pressing the door into the opening present in the fuselage structure. When the locking hook is transferred into its final closed position, by way of the kinematic connection that according to the invention is made as a spring-loaded pivoting wedge that is located perpendicular to the pivoting axis of the locking and catch hooks, the catch hook is released again for a new closing process. The wedge surface and catch step of the pivoting wedge are located on its action surface that faces the end regions of the catch and locking hooks, whereby the pivoting wedge—on which the torsion spring acts in the counterclockwise direction with respect to its bearing bolts as soon as the catch step is dynamically connected to an extension of the catch hook—blocks the latter in its position in which contact with the stop pin has been made.

The execution of the door locking system according to the invention greatly facilitates reliable closing of these doors and therefore increases the ease of operation for the helicopter crew.

BRIEF DESCRIPTION OF THE DRAWINGS

The invention is described below using one exemplary embodiment that is shown more or less schematically in the drawings.

Here.

DETAILED DESCRIPTION

Of a locking device for the folding door of an aircraft, neither of which are shown, especially of a helicopter, FIGS. 1 to 5 show only one of the locking devices 10 that is tightly connected to the folding door and that can be actuated by way of linkage that has a hand lever and that likewise is not shown, and can interact with one fitting at a time that is used as the catch 11 and that is attached to the fuselage structure of the aircraft.

Figure 4:
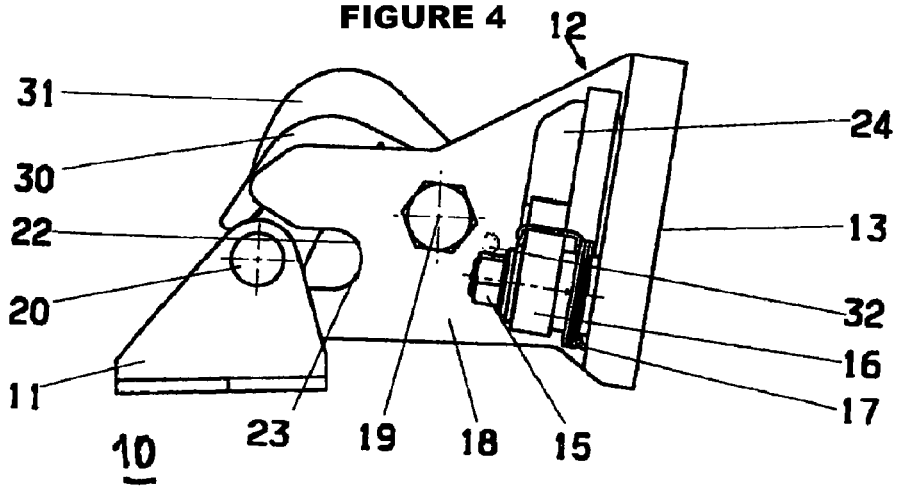
FIG. 4 shows a side view of the locking device according to FIG. 1 in the direction of arrow B with the carrier plate that bears the locking elements.

Each of the locking devices 10 has an angular carrier plate 12, whose part that is bent by roughly 90° forms a flange 13 that is located obliquely—see FIG. 4—to the roughly horizontal action plane of the locking device. The respective locking device is attached to the folding door of the helicopter by way of the flange 13 by means of screws that are not shown here.

Figure 1:
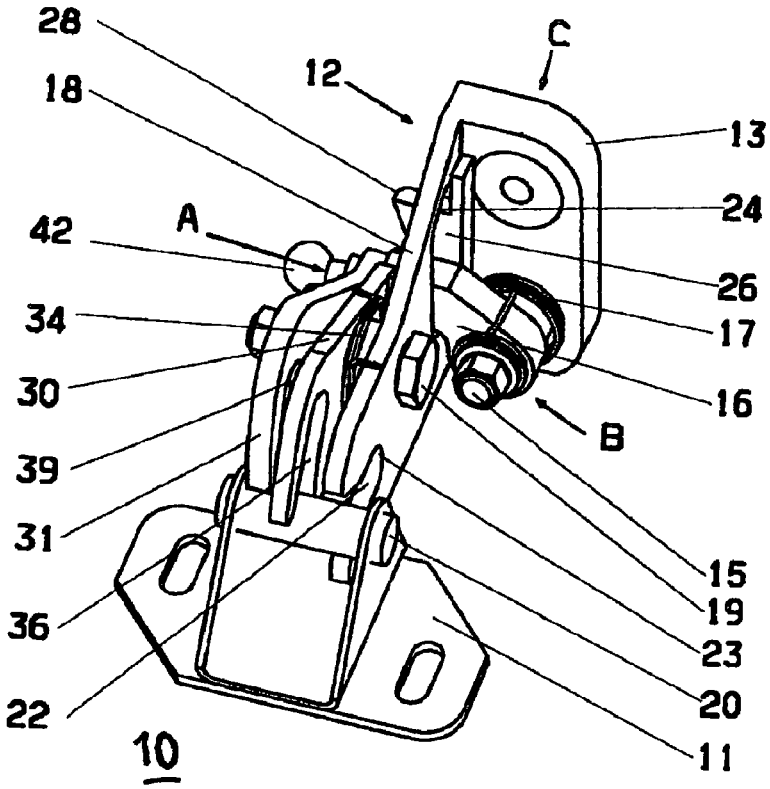
FIG. 1 shows an isometric view of a locking device intended for a folding door of a helicopter according to the invention.

The flange 13 carries a bearing bolt 15 for a pivotally mounted pivoting wedge 16 upon which a torsion spring 17 acts in the counterclockwise direction; compare FIG. 1. A plate-shaped extension 18 of the carrier plate 12 carries a bearing bolt 19 for holding the latch elements that are still to be described and on its free end has a slotted opening 22 that faces the bolt 20 of the catch 11. The rear edge 23 of the slotted opening 22 is used as a stop and thus as a limit of the motion of the folding door into its closed position. The pivoting wedge 16 extends through an opening 24 provided in its region in the extension 18 of the carrier plate 12 into the pivoting region of the latch elements that are still to be described.

Figure 5:
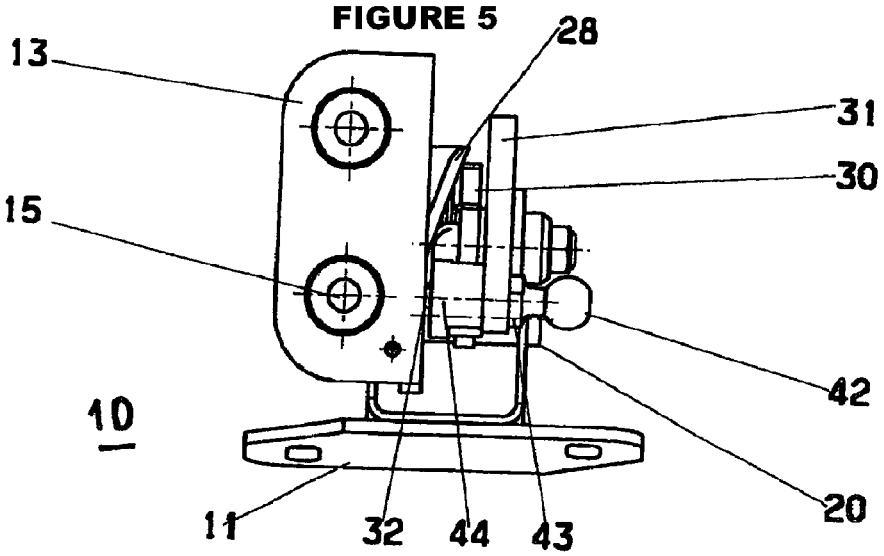
FIG. 5 shows a side view of the locking device according to FIG. 1 in the direction of arrow C.

The pivoting wedge 16 for purposes of guidance in the opening 24 of the carrier plate 12 has a lateral extension 26 that with the front side of the free end of the pivoting wedge forms a common wedge surface 28; compare FIG. 5. Furthermore, laterally offset to the wedge surface 28 is a catch step 29—FIG. 2—which, as will be described below, is used for temporary locking of one of the latch elements.

The indicated latch elements comprise a catch hook 30, made as a double-armed lever, and, adjacent to it, a locking hook 31—that acts as a latch—that is likewise made as a double-armed lever and that acts as a so-called latch, and that are both pivotally supported on the bearing bolt 19 of the carrier plate 12. A torsion spring 34 acts on the catch hook 30 in the clockwise direction with reference to the bearing bolt 19—compare FIG. 1. The motion of the catch hook 30 in the counterclockwise direction is limited by a stop pin 32 that is attached in the plate-shaped extension 18 of the carrier plate 12. The catch hook 30 on its free end facing the bolt 20 has a slotted opening 36 that is pointed down and whose limit stop facing the bolt runs out in a wedge surface 37. The lever arm of the catch hook, which arm faces away, bears an extension 38 that faces the carrier plate and that interacts with the catch step 29 of the pivoting wedge 16; compare FIG. 2.

Figure 3:
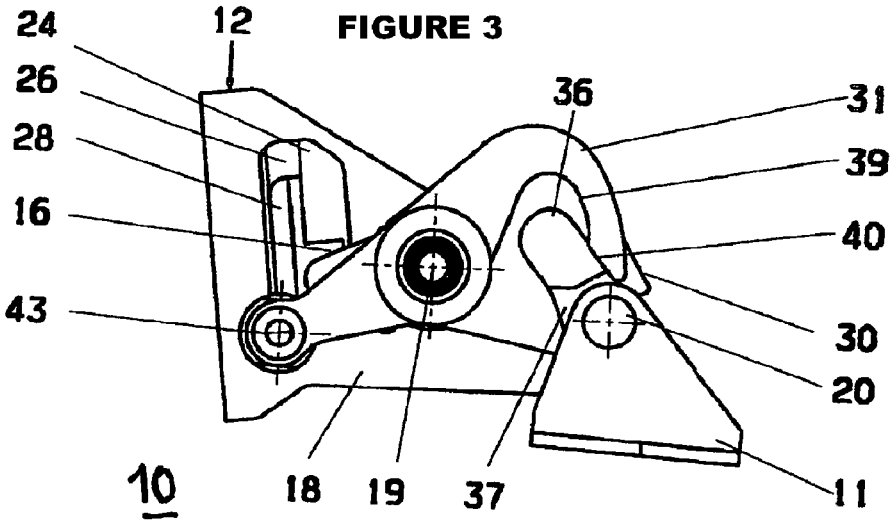
FIG. 3 shows a side view of the locking device according to FIG. 1 in the direction of arrow A.

The free end of the double-armed locking hook 31 facing the bolt 20 likewise has a slotted opening 39 that on its free end passes into a wedge surface 40; compare FIG. 3. The indicated wedge-surfaces 36 and 39 of the pertinent latch elements, specifically the catch hook 30 and the locking hook 31, support the catching and locking motion of the latch elements in the clockwise direction around their bearing bolts by way of the bolt 20 as soon as the folding door is transferred by hand into a position near the closing position.

Figure 2:
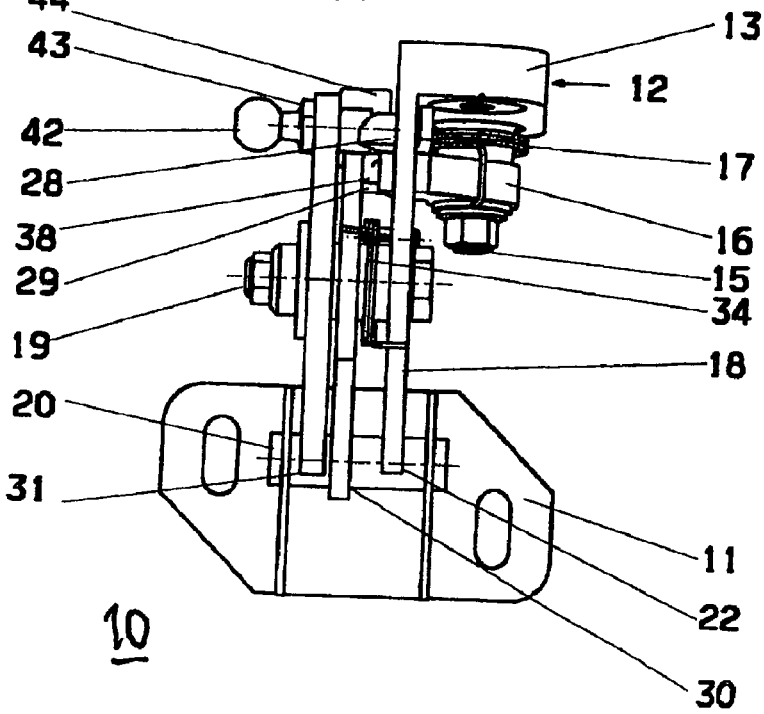
FIG. 2 shows a top view of the locking device according to FIG. 1.

The lever arm of the locking hook 31, which arm faces away, bears a hinge pin 43 that is provided with a ball head 42—compare FIG. 2—that by means of a sleeve 44 projects into the pivot region of the catch and locking hooks, and into the region of the wedge surface 28 of the pivoting wedge 16 in order to move the latter, as will be described.

The above-described locking device works as follows:

As already mentioned, as soon as the folding door is moved into the closed position by way of the wedge surface 28, the catch lever 30 is pivoted by the bolt 20 relative to FIG. 3 in the clockwise direction around the bearing bolt 19 against the action of the spring 34 by a small angular amount. In this connection, the catch hook with its opening 36 of one lever arm encompasses the bolt 20 and with its other lever arm that faces away moves the pivoting wedge 16 by means of its extension 38—FIG. 2—opposite the action of the spring 17 in the clockwise direction until the illustrated blocking position is reached, in which the pivoting wedge 16 and catch hook 30 are locked to one another by way of the catch step 29 of the pivoting wedge and the extension 38 of the catch hook, which extension is acting there. Thus, the folding door is held in the position that it has just assumed—is thus "caught." If at this point the locking hook 31 is moved around the bearing bolt 19 with respect to FIG. 3 in the clockwise direction by way of the linkage that is not shown by means of its hand lever—that so far has assumed its normal position and at this point is moving into the closed position—the locking hook 31 with its slotted opening 39 thus now completely encompasses the bolt 20 and—with simultaneous tightening of the door fold in its door opening within the fuselage structure of the helicopter—locks the latter in the closed position. To do this, the locking hook 31, as already mentioned, on its free lever arm bears the bolt 43 with the ball head 42 that is dynamically connected to the indicated linkage for locking the door. During movement of the locking hook 31 into the blocking position, it moves, as the result of its travel that is chosen to be greater compared to the catch hook 30—according to the greater length of the lever arm relative to the bearing bolt 19—compare FIG. 2—the pivoting lever 16 out of its blocking position and thus by way of the extension 38 releases the catch hook 30 for a new process when the folding door is closed again. Due to the greater travel of the locking hook 31, specifically beginning at a certain angular position, the pivoting wedge 16 is pivoted so far that the spring-loaded catch hook 30 that is released in doing so can pivot back again into its initial position for a new catch process when the folding door is closed.

REFERENCE NUMBER LIST

10 locking device
11 catch
12 carrier plate
13 flange
15 bearing bolt
16 pivoting wedge
17 torsion spring
18 plate-shaped extension
19 bearing bolt
20 bolt
22 slotted opening
23 rear edge of the slotted opening
24 opening
26 lateral extension
28 wedge surface
29 catch step of the pivoting wedge 16
30 double-armed catch hook
31 double-armed locking hook
32 stop pin
34 torsion spring

36 slotted opening
37 wedge surface of the catch hook
38 extension of the catch hook
39 slotted opening
40 wedge surface of the locking hook
42 ball head
43 hinge pin
44 sleeve

What is claimed is:

1. Door lock for doors of helicopters, the door lock comprising:

a locking hook attachable to a door structure, the locking hook having a first elongated side surface extending a first length along the locking hook in a lengthwise direction along a first plane;

a catch attachable to a fuselage structure, the catch having a bolt, the bolt having a longitudinal axis located substantially at a right angle to the first plane, the locking hook, by way of a manually activated linkage, being releasably connectable to the bolt to be movable between a blocking position when connected to the bolt and a release position when unconnected to the bolt;

a spring-loaded catch hook connected by a bearing bolt to the locking hook, the catch hook being engageable with the bolt, the catch hook having a second elongated side surface extending a second length along the catch hook in the lengthwise direction along a second plane, the second length being different from the first length;

the locking hook and the catch hook being supported by the bearing bolt equiaxially on a carrier plate, the locking hook and the catch hook each having a hook-shaped opening, the bearing bolt of the catch and locking hooks having a second longitudinal axis; and a spring-loaded pivoting wedge having a wedge surface and a catch step; and the spring-loaded pivoting wedge being pivotally supported on the carrier plate by a second bearing bolt having a third longitudinal axis, with the third longitudinal axis of the second bearing bolt being located substantially perpendicular to the second longitudinal axis of the bearing bolt of the catch and locking hooks.

2. Door lock according to claim 1, wherein the pivoting wedge projects through an opening in the carrier plate into a pivoting region of the locking hook and the catch hook.

3. Door lock according to claim 1, wherein the wedge surface and the catch step of the pivoting wedge are located on its action surface that faces the end regions of the catch and locking hooks, and wherein the pivoting wedge, on which the torsion spring acts in the counterclockwise direction with respect to the second bearing bolt when the catch step is connected to an extension of the catch hook, blocks the latter in its position in which contact with the stop pin has been made.

4. Door lock according to claim 1, wherein the free end of the carrier plate facing the catch has a slotted opening, whose rear edge is used as the end stop for the door.

5. Door lock according to claim 1, wherein the pivoting wedge is supported on a bend of the carrier plate that is used as a flange.

6. Door lock according to claim 5, wherein the wedge surface and the catch step of the pivoting wedge are located on its action surface that faces the end regions of the catch and locking hooks, and wherein the pivoting wedge, on which the torsion spring acts in the counterclockwise direction with respect to the second bearing bolt when the catch step is connected to an extension of the catch hook, blocks the latter in its position in which contact with the stop pin has been made.

7. Door lock according to claim 2, wherein the wedge surface and the catch step of the pivoting wedge are located on its action surface that faces the end regions of the catch and locking hooks, and wherein the pivoting wedge, on which the torsion spring acts in the counterclockwise direction with respect to the second bearing bolt when the catch step is connected to an extension of the catch hook, blocks the latter in its position in which contact with the stop pin has been made.

8. Door lock according to claim 2, wherein the free end of the carrier plate facing the catch has a slotted opening, whose rear edge is used as the end stop for the door.

9. Door lock according to claim 3, wherein the free end of the carrier plate facing the catch has a slotted opening, whose rear edge is used as the end stop for the door.

10. Door lock according to claim 5, wherein the free end of the carrier plate facing the catch has a slotted opening, whose rear edge is used as the end stop for the door.

11. Door lock according to claim 6, wherein the free end of the carrier plate facing the catch has a slotted opening, whose rear edge is used as the end stop for the door.

12. Door lock according to claim 7, wherein the free end of the carrier plate facing the catch has a slotted opening, whose rear edge is used as the end stop for the door.

13. Door lock for doors of helicopters, the door lock comprising:

a locking hook attachable to a door structure, the locking hook having a first elongated side surface extending a first length along the locking hook in a lengthwise direction along a first plane;

a catch attachable to a fuselage structure, the catch having a bolt, the bolt having a longitudinal axis located substantially at a right angle to the first plane, the locking hook, by way of a manually activated linkage, being releasably connectable to the bolt to be movable between a blocking position when connected to the bolt and a release position when unconnected to the bolt;

a spring-loaded catch hook connected by a bearing bolt to the locking hook, the catch hook being engageable with the bolt, the catch hook having a second elongated side surface extending a second length along the catch hook in the lengthwise direction along a second plane, the second length being different from the first length;

the locking hook and the catch hook being supported by the bearing bolt equiaxially on a carrier plate, the locking hook and the catch hook each having a hook-shaped opening, the bearing bolt of the catch and locking hooks having a second longitudinal axis; and a spring-loaded pivoting wedge that projects through an opening in the carrier plate into a pivoting region of the locking hook and the catch hook, the spring-loaded pivoting wedge being pivotally supported on the carrier plate by a second bearing bolt having a third longitudinal axis, with the third longitudinal axis of the second bearing bolt being located substantially perpendicular to the second longitudinal axis of the bearing bolt of the catch and locking hooks.

14. Door lock for doors of helicopters, the door lock comprising:

a locking hook attachable to a door structure, the locking hook having a first elongated side surface extending a first length along the locking hook in a lengthwise direction along a first plane;

a catch attachable to a fuselage structure, the catch having a bolt, the bolt having a longitudinal axis located substantially at a right angle to the first side of the locking hook, the locking hook, by way of a manually activated linkage, being releasably connectable to the bolt to be movable between a blocking position when connected to the bolt and a release position when unconnected to the bolt;

a spring-loaded catch hook connected by a bearing bolt to the locking hook, the catch hook being engageable with the bolt, the catch hook having a second elongated side surface extending a second length along the catch hook in the lengthwise direction along a second plane, the second length being different from the first length, the locking hook and the catch hook being supported by the bearing bolt equiaxially on a carrier plate, the locking hook and the catch hook each having a hook-shaped opening, the bearing bolt of the catch and locking hooks having a second longitudinal axis; and a spring-loaded pivoting wedge that has a wedge surface and a catch step, the spring-loaded pivoting wedge being pivotally supported on the carrier plate by a second bearing bolt having a third longitudinal axis, with the third longitudinal axis of the second bearing bolt being located substantially perpendicular to the second longitudinal axis of the bearing bolt of the catch and locking hooks, wherein the wedge surface and the catch step of the pivoting wedge are located on its action surface that faces the end regions of the catch and locking hooks, and wherein the pivoting wedge, on which the torsion spring acts in the counterclockwise direction with respect to its bearing bolt when the catch step is connected to an extension of the catch hook, blocks the latter in its position in which contact with the stop pin has been made.

* * * * *